United States Patent [19]

Packer

[11] 4,097,347

[45] Jun. 27, 1978

[54] ELECTROLYTIC RECOVERY OF METALS

[76] Inventor: Elliot L. Packer, 1015 Prospect Ave., Plainfield, N.J. 07060

[21] Appl. No.: 716,828

[22] Filed: Aug. 23, 1976

[51] Int. Cl.[2] ..... C25C 1/20; C25D 5/42

[52] U.S. Cl. ..... 204/109; 204/32 R; 204/29; 204/40; 204/49

[58] Field of Search ..... 204/281, 290 R, 290 F, 204/284, 109, 49, 32 R, 40, 29

[56] References Cited

U.S. PATENT DOCUMENTS

| | | | |
|---|---|---|---|
| 2,275,194 | 3/1942 | Sizelove | 204/290 R |
| 2,529,237 | 11/1950 | Turner et al. | 204/24 |
| 2,646,396 | 7/1953 | Dean | 204/281 |
| 2,835,630 | 5/1958 | Huddle et al. | 204/290 F |
| 2,870,068 | 1/1959 | Schaer | 204/11 |
| 3,857,763 | 12/1974 | Du Bois | 204/281 |
| 3,883,411 | 5/1975 | Gendron et al. | 204/281 |

OTHER PUBLICATIONS

Handbook of Chem. & Physics, 32nd Ed., 1950, Chem. Rubber Publ. Co., pp. 496–497, 534–535.

"Corrosion Props. of Ti & its Alloys," by D. Schlain, Bur. of Mines Bulletin, 619, 1964, p. 110.

Principles of Electroplating & Electroforming by Blum et al., Third Ed., 1949, p. 423.

Electroplating Engineering Handbook, Second Ed., A. K. Graham et al., 1962, p. 234.

*Primary Examiner*—R. L. Andrews

*Attorney, Agent, or Firm*—McAulay, Fields, Fisher & Goldstein

[57] ABSTRACT

A titanium or tantalum cathode which has a nickel coat on it is used for the electrolytic recovery of gold from solution. The gold is stripped from the cathode by use of aqua regia which strips the nickel coat but does not affect the underlying titanium or tantalum. The amount of nickel is only enough to prevent destructive hydrogen absorption by the titanium or tantalum and is not enough to significantly contaminate the recovered gold. The cathode can then be reused by applying a new nickel coat and repeating the process.

6 Claims, 4 Drawing Figures

ELECTROLYTIC RECOVERY OF METALS

BACKGROUND

This invention relates to an improved technique for recovering metals, and more particularly gold, from solution by the electrolytic process.

It has long been known that gold can be recovered from solution through an electrolytic process. The gold is collected on a cathode and once collected has to be removed from the cathode.

One commercial area where gold recovery is important is in the gold plating business. Articles that have been gold plated are rinsed and the gold accumulates in the rinse in ionic form. A common way of recovering gold from a rinse is through an electrolytic process in which a flat rectangular polished stainless steel cathode is used. The gold is collected on the cathode. It is then mechanically scraped from the cathode and thus recovered. This process has the advantage of being simple and minimizes subsequent refining. Because the gold must be scraped from the cathode, a wire mesh cathode or expanded metal cathode cannot be used and thus some recovery efficiency is lost. In order to make sure that the gold can readily be scraped off the cathode, high adherence between cathode and gold is avoided. The cathode is preferably polished to minimize adherence. As a result, during the recovery process, the gold tends to flake off the cathode in small particles which are distributed in the solution and are thrown out with the solution.

To enhance efficiency and avoid flaking, it is known to recover gold on a copper wire mesh cathode. Aqua regia is then used to dissolve the gold. But the problem is that aqua regia also dissolves the entire cathode material and the aqua regia solution is contaminated by a substantial amount of base metal. The cathode cannot be reused and further processing steps are necessary to separate the gold from the cathode metal in order to obtain a desired commercial purity for the recovered gold.

Titanium or tantalum might be used as the base metal of the cathode because these two metals are not attacked by aqua regia. But the trouble is that hydrogen is generated during the electrolytic process. These two metals absorb hydrogen and become brittle after they have absorbed the hydrogen. Titanium may absorb up to 20,000 times its weight in hydrogen. When brittle, these metals break too readily and are not commercially useful. Thus, titanium and tantalum have not been used as the cathode materials in the electrolytic recovery of gold because it has been deemed impractical to use them.

The major purpose of this invention is to provide an improved and simplified electrolytic gold recovery process in which an improved trade-off is obtained between efficiency during the recovery process and contamination during the process of separating the gold from the cathode.

As will become clear from the description of the invention, it is a related purpose of this invention to provide a less expensive, a quicker, and a surer technique for recovering all of the gold from a gold solution and for providing the recovered gold in a form pure enough to meet most commercial requirements.

It is also a related purpose of this invention to provide a reusable cathode which can have a configuration that will provide optimum efficiency.

BRIEF DESCRIPTION

In brief, in one embodiment of the invention, an expanded metal cathode made from titanium is used for the electrolytic recovery of gold from solution. This cathode is coated with a thin layer of nickel to thereby provide a coating dense enough to prevent absorption of hydrogen by the titanium during the recovery process. In this fashion, the titanium is protected from the hydrogen that is generated at the cathode. The cathode is then preferably flashed with gold to provide an efficient surface for the accumulation of gold.

The gold ion containing solution, which might be a rinse solution, is flowed through a chamber containing an anode and this cathode. The rinse solution is circulated through the electrolytic chamber as often as required to attain a desired low concentration of gold ions.

After the gold being recovered has been plated on the cathode to the thickness desired, the cathode is removed from the solution and the gold is stripped from the cathode by inserting it in aqua regia. The stripping process removes the nickel coat as well as all the gold but does not affect the underlying titanium metal. A nickel coat is then reapplied to the titanium base to provide a cathode element that can be reused for another cycle of gold recovery.

THE DRAWINGS

DESCRIPTION OF THE PREFERRED EMBODIMENT

Figure 1:
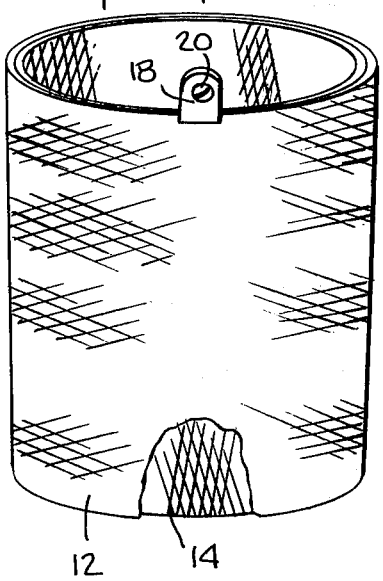
FIG. 1 is a schematic representation of a cylindrical cathode employing the stacked expanded metal structure preferred as a cathode structure for the recovery process of this invention.

The cathode structure shown is an expanded metal structure. This configuration provides a greater surface area, for a given weight of cathode, than does the flat plate. The surface of the cathode 10 is preferably sand blasted to further increase surface area. The major reason for seeking enhanced surface area is to increase cathode efficiency.

Cathode efficiency, as used herein, is a figure of merit that relates to the rate at which metal is removed. Cathode efficiency as commonly used commercially is measured in grams per ampere-hour. Thus the greater the cathode efficiency, the greater the rate at which the metal is plated out from solution. In this commercial usage, cathode efficiency is a function of the metal being plated out and is very much a function of the concentration of the metal. For example, for gold, cathode efficiency may vary from a figure of 7.2 grams per ampere-hour for gold having a concentration substantially greater than 1000 parts per million to 0.07 grams per ampere-hour for gold having very low concentration in the order of ten parts per million. There are other process variables such as flow rate which will affect cathode efficiency. However, the configuration of the electrode structure, the relationship between electrodes, the shape and surface area of the electrodes and the total geometric configuration of the electrodes in the container within which they are supported will provide what could be termed a cathode efficiency factor. The higher the cathode efficiency factor, the higher then will be the cathode efficiency under any given set of operating conditions, such as flow rate, concentration and the nature of metal ion in solution. By contrast with the above usage, cathode efficiency is used in the academic literature as a percentage figure relating actual plating output to the theoretical maximum calculated by Faraday's law. However, reference to efficiency in this application means cathode efficiency as commercially used and defined above.

The techniques of sand blasting the cathode is a known technique and was used in order to generate a greater cathode surface area. A preferred sand blasting is to use both fine (No. 00) and coarse (No. 1) sand. The coarse sand creates deep pitting. The fine sand causes pitting between deeper pits; that is, picks up areas the coarse sand misses. It is preferable to pit to the point where a dull surface is provided with no visible bright spots. Sand blasting can provide approximately a doubling of surface area and thus of cathode efficiency.

A thin nickel coating on a cathode made of titanium or tantalum protects the titanium or tantalum from hydrogen absorption during the electrolytic process and thus prevents the cathode metal from becoming brittle and unusable. The nickel coating involved is of the sort that is frequently called a nickel strike. A nickel strike is a known technique used on stainless steel in preparing stainless steel to be plated with gold. It provides a nickel coat onto which gold can be readily plated. A Wood's nickel strike is one known technique for applying the nickel coat, but others are known. The same technique is used to provide a nickel coat on the titanium or tantalum cathode. The nickel coat is relatively non-porous and thus serves to minimize penetration of hydrogen through the coating and thereby minimize hydrogen absorption by the cathode.

This titanium cathode with a nickel strike is used as the cathode for the recovery of gold. Although it can be used for the electrolytic recovery of other metals, it is in the recovery of gold that it would have its greatest applicability.

Because this invention eliminates the scraping of the cathode, the cathode can have the complex surface of a sandblasted, expanded metal structure to provide greater surface area, greater adherence of gold to cathode and improved cathode efficiency.

As in known in the art, it is preferable to flash the cathode with the metal to be recovered and particularly with gold when gold is to be recovered so as to enhance the initial adherence of the gold to the cathode. The nickel not only provides the dense coat that minimizes hydrogen absorption but it also enhances the adherence of gold to the cathode. The gold flash added on top of the nickel is not necessary but does provide further enhancement of initial adherence of gold.

After the processing wherein the gold has been collected on the cathode, the cathode is removed from the solution and inserted into aqua regia. The aqua regia will strip all the gold as well as the nickel strike from the cathode leaving the underlying titanium or tantalum cathode unaffected. Aqua regia attacks most metals but will not attack titanium or tantalum.

The nickel coat is very thin, in the order of one to ten microns. Thus the amount of nickel dissolved out by the aqua regia is very small. Gold is precipitated from the aqua regia in the usual fashion. Because of the small amount of nickel in the aqua regia, the recovered gold is sufficiently pure, from a commercial point of view, so that the refining process does not have to be repeated and so that only a minimum amount of washing of the gold precipitate with hydrochloric acid is required.

Nickel is the preferred metal to be used because it protects the cathode metal and is not attacked by alkaline gold solutions. Copper or brass are dense enough to protect the titanium cathode but they would be attacked by alkaline solutions in those situations where the recovered gold deposits out as a porous coating. Indeed, gold itself can be pre-plated on the cathode to provide the protective function. However, the cost is greater and thus nickel is preferred.

Figure 2:
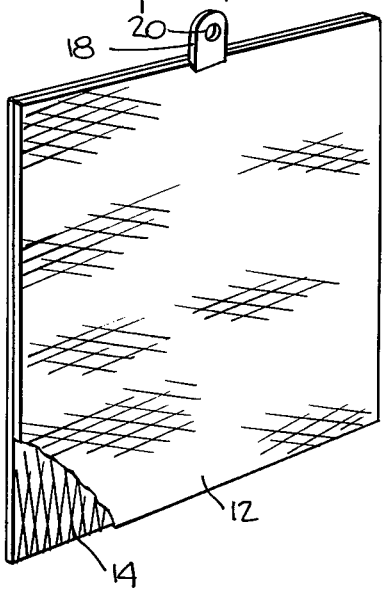
FIG. 2 is a schematic illustration similar to that of FIG. 1 illustrating a planar cathode.
Figure 3:
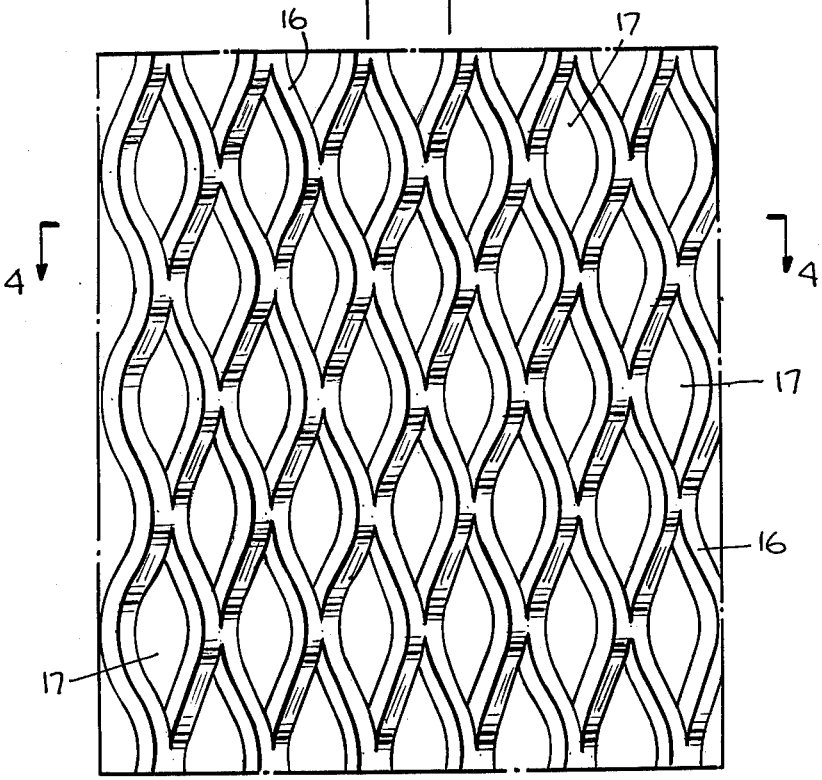
FIG. 3 is a plan view of the surface of the expanded metal structure used in the cathodes shown in FIG. 1 and 2.
Figure 4:
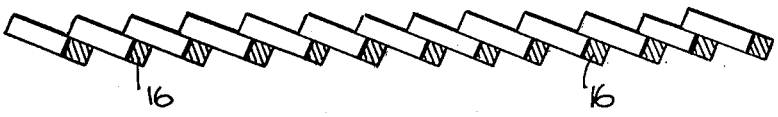
FIG. 4 is a cross-sectional view along the lines 4—4 of FIG. 3.

As shown in the FIGS., a preferred cathode structure is composed of two expanded metal plates 12, 14 which may be either in cylindrical form as shown in FIG. 1 or in flat plate form as shown in FIG. 2. The open grid configuration of an expanded metal structure results in plating out on both sides of the cathode even though the cathode faces an anode on only one of its sides. The reason for this is that the ions will plate out around corners. Thus, although the gold to be plated out will not plate out on the back side of a solid metal cathode where only one side of that cathode faces the anode, it will plate out on both sides of an expanded metal structure because of the grid configuration in which all parts of the back side of the structure are reasonably close to an edge of one of the openings 17. Furthermore, what has been found is that the creation of a cathode structure in which two expanded metal plates 12, 14 are used and tacked together along their peripheries appears to provide about twice as much area for plating out of the gold as does a flat plate. In addition, sandblasting the cathode plates 12, 14 further increases their surface area and thus increases cathode efficiency.

The two expanded metal plates 12 and 14 are stacked so that their patterns are orthogonal and thus there is minimum interference or shadowing of the plate more removed from the anode by the plate closer to the anode.

The use of a dual plate expanded metal cathode structure results in a marked improvement of cathode efficiency by providing not only more surface area but a more effective surface for gold to plate out on than does a flat plate. One reason why the expanded metal surface is more effective than a flat plate surface is that the unevenness of the surface tends to create slight turbulence as the ion containing solution passes over and through the cathode. Thus there is greater diffusion of the ions at the cathode and an increased rate of plating. An expanded metal plate can be used because the gold does not have to be recovered by scrapping it off the plate. Furthermore, this cathode structure in titanium is feasible from a financial and processing point of view only because the basic cathode structure can be reused. It can be reused because the cathode is not soluble in aqua regia. Thus through use of titanium or tantalum an improved cathode structure from the point of view of cathode efficiency becomes possible. But, this titanium or tantalum can be used only because it is coated with a nickel strike thereby preventing hydrogen absorption which otherwise would deteriorate the titanium or tantalum.

The expanded metal structure which has been successfully employed in testing this invention is one in which the strands 16 are substantially square in cross section and have a width on each side of approximately 50 mils (0.050 inches). The openings 17 are about three-eighths of an inch long and three-sixteenths of an inch wide. As schematically suggested by the cross hatching in FIGS. 1 and 2, where the length of the openings 17 of plate 14 are vertical then the length of the openings of plate 12 are horizontal. Because the entire surface of the strands 16 which constitute the grid of the expanded metal structure provides a plating surface, the surface area for the gold to plate on was equal to approximately 2.2 times the effective area provided by a comparable flat plate having the same overall length and width.

The two expanded metal plates 12 and 14 are preferably spot welded to each other at points along their periphery. Spot welding joins the two titanium structures without requiring another metal or flux. A titanium strap 18 together with a bolt 20 and nut (not shown) provide a terminal to which a copper wire can be connected. Normally a copper wire is employed and is electrically connected to the strap 18 through a stainless steel lug which is held in place by the nut and bolt. It is important, when the nickel strike is placed on the titanium cathode, that the titanium strap bolt and nut also be nickel plated. The strap 18 is spot welded to one of the expanded metal titanium plates 12 or 14.

What is claimed is:

1. A metal recovery process for recovering those precious metals that are soluble in aqua regia from an ionic solution by an electrolytic process comprising the steps of:

selecting a cathode made of a material inert to aqua regia, said cathode being composed of metals from the group consisting of titanium and tantalum, sand blasting the surface of said cathode, preplating the surface of said cathode with a thin layer of a conductive adherent metal to provide a coated cathode having a coat that is substantially impervious to hydrogen, inserting said coated cathode into a solution of a precious metal that is soluble in aqua regia, electrolytically recovering said precious metal on said cathode, and dissolving said precious metal and said coat of conductive adherent metal from said cathode by use of aqua regia.

2. The method of claim 1 wherein said cathode is perforated.

3. The method of claim 2 wherein said precious metal is gold.

4. The method of claim 3 wherein said conductive adherent metal is nickel.

5. The method of claim 1 wherein said precious metal is gold.

6. The method of claim 5 wherein said conductive adherent metal is nickel.

* * * * *